US006689028B2

(12) United States Patent
Smith

(10) Patent No.: US 6,689,028 B2
(45) Date of Patent: Feb. 10, 2004

(54) LEG STRETCHING DEVICE AND METHOD OF USE

(76) Inventor: Tracy Smith, 10114 E. 118th St. S., Bixby, OK (US) 74145

( * ) Notice: Subject to any disclaimer, the term of this patent is extended or adjusted under 35 U.S.C. 154(b) by 0 days.

(21) Appl. No.: 10/012,961

(22) Filed: Nov. 5, 2001

(65) Prior Publication Data

US 2002/0055425 A1 May 9, 2002

Related U.S. Application Data

(60) Provisional application No. 60/246,220, filed on Nov. 6, 2000.

(51) Int. Cl.[7] ..... A63B 71/00
(52) U.S. Cl. ..... 482/148; 482/907; 482/140
(58) Field of Search ..... 482/148, 907, 482/142, 145, 79, 92, 140

(56) References Cited

U.S. PATENT DOCUMENTS 5,122,106 A * 6/1992 Atwood et al. ..... 482/131
5,647,823 A * 7/1997 Spence ..... 482/91

* cited by examiner

*Primary Examiner*—Nicholas D Lucchesi
*Assistant Examiner*—L Amerson
(74) *Attorney, Agent, or Firm*—Angenehm Law Firm; N Paul Friederichs

(57) ABSTRACT

A medical appliance for assisting in the performance of exercises for regaining lost range of motion in a previously traumatized knee joint of the leg of a patient having a planar leg support with a first end and a second end, the leg support further having a cushion attached on the first end thereof, the cushion surrounding the first end of the planar support and being further adapted for fitment adjacent to and behind the knee joint to support and locate the lower leg for performance of exercises, and an elongate stretcher removably attachable to the to the leg support whereby the patient may apply force to the to the stretcher increasing the range of movement in the previously traumatized knee.

19 Claims, 1 Drawing Sheet

LEG STRETCHING DEVICE AND METHOD OF USE

This application has a priority based on a previously filed Provisional Application Ser. No. 60/246,220 filed Nov. 6, 2000.

BACKGROUND OF THE INVENTION

The device as described in the appended application is a device used to assist patients recovering from knee surgery. More particularly, the device is a medical therapy apparatus used to assists patients recover the range of movement in the knee joint after injury or surgery.

Following trauma, such as an injury or surgery, a patient will lose range of motion in the effected joint. Most frequently, the loss of range of movement is a result of trauma to the muscles, tendons, or ligaments. Frequently, the effected body parts must be forcibly stretched to regain the pre-trauma range of movement. The forceful stretching often requires that the joint be moved to or beyond a point of maximum comfortable extension and then either held in that position or moved further to stretch the effected muscles, tendons, or ligaments. The stretching must be controlled, as too great of stretching or too forceful of stretching will at least inhibit healing, if not re-injure the joint.

One of the difficulties of rehabilitation is for the patient to recover the loss of motion that the surgery or illness has taken. In the past, physical therapy has been used to restore the range of motion. However, physical therapy usually requires repetitive movement of the effected joint, often to the limits of motion and beyond, which all too frequently is both painful and time-consuming. So long as a physical therapist is assisting the patient with the prescribed exercises, recovery will proceed. However, when the exercises are not performed or performed improperly, the process of recovery slows or ceases.

An additional problem that may be encountered is that following an injury or surgery the knee joint may become unstable and the exercises are even more difficult to perform due to the instability. When another person assists the patient in performing the exercises, the other person may stabilize the joint so that the movement remains in the correct plane and the correct direction and no additional harm occurs to the joint. However, when the patient is exercising alone they do not have the luxury of the assistant and it becomes more difficult to perform the exercises. As a result, the patient may either not perform the exercises, or perform the exercises incorrectly. The results of either option are not conducive to recovery for the patient. With the reduction of length of hospital stays, and the increase in home health care a need for a simple device used to assist a patient with their therapy to regain the range of movement in the effected joint has become necessary.

Previously, other devices have been developed that attempt to resolve the problems. Some of the devices are complex and expensive and therefore are better suited for hospital use in a physical therapy department. This class of devices is beyond the cost that most patients can incur.

Presently, when the exercises are being done in a home environment, there are no appliances available to assist either the patient or the home health care professional with the therapy necessary to assist the patient in regaining the range of motion that the patient once had.

Without any suitable appliances to assist the patient, the patients must make do with their own ingeniousness, which often means that the patient must bend their body into an uncomfortable position and, from the uncomfortable position, urge their knee into a further bent position without twisting or otherwise moving the knee improperly. This task, all too often proves to be so difficult that the patient does not do the exercises and fails to regain the range of motion that the patients enjoyed before the injury or surgery.

SUMMARY OF THE INVENTION

The leg stretcher, as described herein, is a padded appliance for placement behind the knee and lower leg to support and guide the lower leg as the knee is moved through a range of movement. There is a planet olanar leg support mechanism for supporting the lower leg, having a cushioning mechanism formed on one end. The cushioning mechanism is provided to increase the comfort of the patient during use.

The leg stretcher may be attachable to the patient's leg to provide further comfort and utility. The leg stretcher may be attached using an attachment mechanism, such as flexible straps. The leg stretcher may include a strap that extends around the leg of the patient and the appliance itself allowing the patient to more easily reach the strap. Pulling on the strap will cause increased movement in knee joint without forcing the patient into an unduly uncomfortable position.

A feature of the leg stretcher is to provide an appliance for stabilizing a body limb while exercising to regain the pre-trauma range of motion.

It is another feature of the leg stretcher to provide an appliance that reduces the opportunity to perform prescribed exercises incorrectly.

It is still another feature of the leg stretcher to provide an appliance that enhances a patient's ability to perform prescribed exercises without assistance from another person.

DETAILED DESCRIPTION

Figure 1:
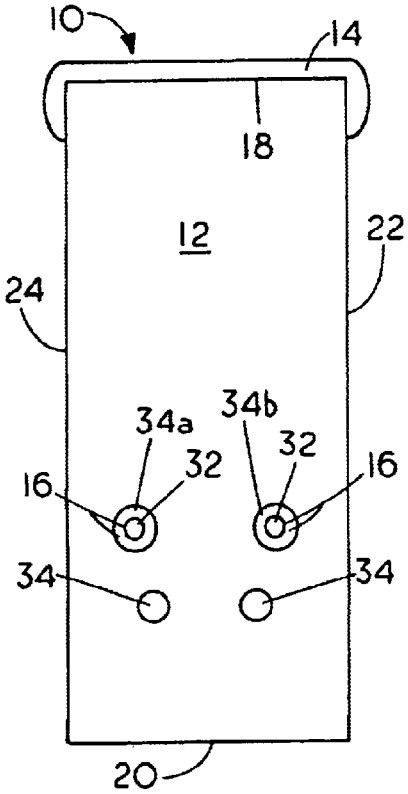
FIG. 1 shows a front elevation view of the leg stretcher.
Figure 2:
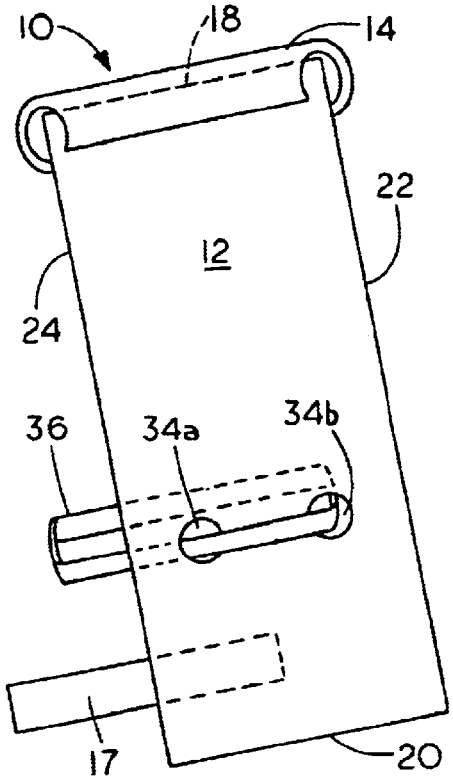
FIG. 2 is a front perspective view of the leg stretcher with both a strap and a stabilizer attached.
Figure 3:
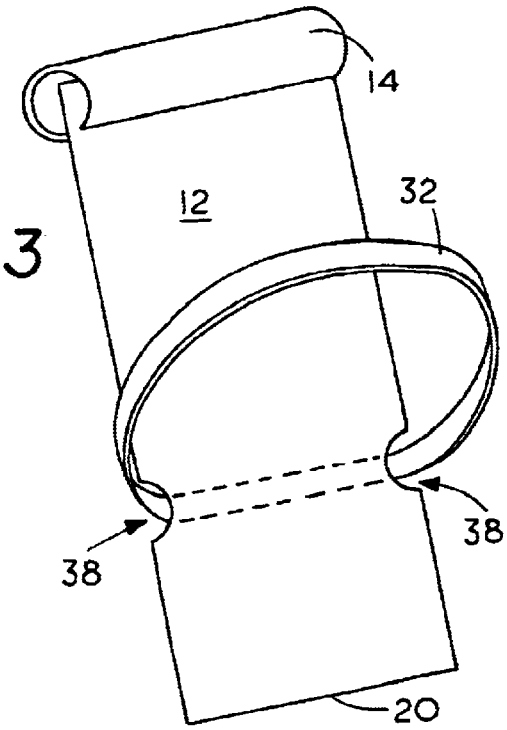
FIG. 3 is a front perspective view of a second embodiment of the leg stretcher showing an alternate mechanism for attaching a strap.

The leg stretcher 10, as shown in FIGS. 1 and 2, includes a leg support mechanism 12 for providing support to a leg, a cushioning mechanism 14 for providing comfort to the leg, and may include a stretching mechanism 16 for self-stretching of an injured knee and/or a stabilizing mechanism 17 for providing more stability to the leg stretcher 10. These mechanisms 12, 14, 16, 17 are described below more fully.

The leg support mechanism 12 may be of a variety of lengths and widths. The length needs to be long enough to provide stability when placed beneath a patient's lower leg and behind the patient's knee. The length may range from longer than the patient's lower leg to shorter than 17 inches. The preferable length ranges from approximately 16 inches to approximately 20 inches. The width may be slightly wider than the patient's lower leg. The width may range from several inches wider than the patient's lower leg to narrower than 4 inches. The preferable width ranges from approximately 4 inches to approximately 6 inches.

The leg support mechanism 12 may be of a variety of shapes. The preferable shape is approximately rectangular having a first end 18, a second end 20, a right side 22, and a left side 24. The leg support mechanism 12 may include two right angles located at the first end 18. The leg support mechanism 12 may include rounded corners for more comfort to the back of the patient's knee. The top end 18 may have a curved portion for providing more comfort to the back of the patient's knee. The second end 20 generally will not be in contact with the patient's leg. The leg support mechanism 12 may be made of any material having sufficient strength and weight. The material needs to avoid degradation so that the leg support mechanism 12 does riot break or crack during use. The weight is not overly important, although the leg support mechanism 12 preferably is sufficiently lightweight to be portable while being sufficiently heavy enough to prevent breakage of the leg support mechanism 12. Suitable materials include wood, hard polymers, or aluminum or other suitable material having the aforementioned properties.

The cushioning mechanism 14, for providing comfort to the leg and knee, may be a variety of sizes. The cushioning mechanism 14 needs to be large enough to cover the first end 18 of the leg support mechanism 12, although the cushioning mechanism 14 should be small enough to remain securely affixed to the first end 18.

The cushioning mechanism 14 may be made of a variety of materials. The material may be any material that provides a cushion between the leg support mechanism 12 and the patient's knee. The material may be a cloth such as terry cloth, expanded polymer padding, sheepskin covering, vinyl padding, or any other suitable material having the properties of having a cushioning effect and providing sufficient longevity during use. A combination of these materials may be used to form the cushioning mechanism 14.

The stretching mechanism 16 for self-stretching of an injured knee may include a strap 32 and a plurality of openings 34 defined by the leg support mechanism 12. The strap 32 may range in length and material. The strap 32 needs to be long enough to be inserted into at least one opening 34*a* of the plurality of openings 34 and reinserted into a second opening 34*b* creating a loop 36. The loop 36 may be long enough to allow the patient's ankle, shin, or lower leg to fit within the loop 36. The length of the strap 32 may range from less than two feet to more than five feet. Preferably, the length of the strap 32 will be approximately three feet. The strap 32 may be made of any flexible material that does not crack or break easily. It is preferred that the strap 32 have sufficient diameter so that the strap 32 will not dig into the leg of the patient during use and create additional unnecessary pain for the patient. The strap 32 may be made of cotton, flexible plastic, or polyester, or other suitable material.

The plurality of openings 34 may be located, in pairs, at varying distances from the first end 18, although preferably only one pair of openings 34 will be present. The pairs of openings allow the strap 32 to be placed at varying locations to enable multiple patients having varying leg lengths to use the same leg support mechanism 12. The plurality of openings 34 may be different shapes and sizes. The plurality of openings 34 may be circular, square, rectangular or other shape. Preferably, the plurality of openings 34 are circular. The plurality of openings 34 may range in size from approximately one-half inch to approximately three inches. Preferably, the plurality of openings 34 is approximately one inch in size.

The stabilizing mechanism 17 may be attached to a bottom portion of the leg support mechanism 12. The stabilizing mechanism 17 may be attached using a hinged mechanism, a temporary attaching mechanism or a permanent attaching mechanism. The stabilizing mechanism 17 may be attached towards the second end 20 or the stabilizing mechanism 17 may be attached towards toward the bottom center of the leg support mechanism 12.

The stabilizing mechanism 17 may range in length and material. The length may range from a few inches to four or more feet and preferably is six inches to one foot. Different lengths may be used depending upon the patient, location of the patient and preferences of those involved in its use. The material needs to avoid degradation so that the stabilizing mechanism 17 does not break or crack during use. Suitable materials include, but are not limited to wood, hard plastic, or aluminum.

An alternative embodiment of the present invention 10 includes the leg support mechanism 12, the cushioning mechanism 14, and may include the stabilizing mechanism 17 as described above. The alternative embodiment of the present invention 10 includes the stretching mechanism 16. The stretching mechanism 16, for self-stretching of an injured knee, may include a strap 32 and a plurality of slots 38 defined by the leg support mechanism 12. The strap 32 may range in length and material. The strap 32 needs to be long enough to be slid into at least one slot 38*a* of the plurality of slots 38 on the left side 24 as well as slid into a second slot 38*b* on the right side 22 creating a loop 36. The loop 36 may be long enough to allow the patient's ankle, shin, or lower leg to fit within the loop 36. The length of the strap 32 may range from less than two feet to more than five feet. Preferably, the length of the strap 32 will be approximately three feet. The strap 32 may be made of any material that does not crack or break easily. The strap 32 may be made of cotton, flexible plastic, or polyester, or other suitable material.

The plurality of slots 38 may be located, in pairs, at varying distances from the first end 18. The pairs of slots allow the strap 32 to be placed at varying locations to enable multiple patients to use the same leg support mechanism 12. The plurality of slots 38 may range in length from approximately one-half inch to approximately three inches. Preferably, the plurality of slots 38 is approximately one and one-half inches in length.

In its use, the leg stretcher 10 is easily prepared for use. The leg support mechanism 12 is disposed beneath the lower leg of the patient having a previously traumatized knee. The cushioning mechanism 14 is located adjacent to the injured knee. Once the leg support mechanism 10 is properly positioned, the injured knee may be stretched in one of three procedures.

In the first procedure, the patient may allow the lower portion of their leg to hang so that gravity may assist in stretching the injured knee. In the second procedure, a second person may stabilize the leg support mechanism 10 with one hand and use his/her other hand to apply pressure to the patient's shin or foot to stretch the injured knee. In the third procedure, the stretching mechanism 16 may be used. The strap 32 would be placed through the appropriate at least one openings 34. The patient would then place the strap 32 over his/her lower leg/shin. Then the patient may pull on the strap 32 to stretch the injured knee.

Although the present invention has been described with reference to preferred embodiments, workers skilled in the art will recognize changes may be made in form and detail without departing from the spirit and scope of the invention.

What is claimed is:

1. A medical apparatus for regaining lost range of motion in a previously traumatized knee joint comprising:

a planar leg support having a first end and a second end;

means for stabilizing the planar leg support flexibly attached to the planar leg support;

a cushion attached on the first end of the planar leg support, the cushion surrounding the first end of the planar leg support and being further adapted for fitment adjacent to and behind a knee joint and adapted to support and locate a lower leg for performance of exercises; and an elongate stretcher removably attachable to the planar leg support.

2. The medical apparatus as described in claim 1 wherein the planar leg support is rectangular in shape.

3. The medical appliance apparatus as described in claim 1 wherein the planar leg support is between twelve and twenty-four inches in length.

4. The medical apparatus as described in claim 1 wherein the planar leg support is between sixteen and twenty inches in length.

5. The medical apparatus as described in claim 1 wherein the planar leg support has a width between four and six inches.

6. The medical apparatus as described in claim 1 wherein the planar leg support has a width of approximately six inches.

7. The medical apparatus as described in claim 1 wherein the planar leg support is sized and configured to approximate a width of a leg of a patient.

8. The medical apparatus as described in claim 1 wherein the cushion completely surrounds and covers the first end of the planar leg support.

9. The medical apparatus as described in claim 1 wherein the cushion is removable.

10. The medical apparatus as described in claim 1 wherein the elongate stretcher is a flexible woven strap.

11. The medical apparatus as described in claim 1 wherein the elongate stretcher is attached to the planar leg support by selectable passage through a plurality of holes defined in the planar leg support.

12. The medical apparatus as described in claim 11 wherein the planar leg support defines multiple sets of pluralities of holes, at varying distances from the first end along the length of the planar leg support, for attachment of the elongate stretcher, whereby patients of varying leg lengths may use the same planar leg support with proper fitment.

13. The medical apparatus as described in claim 1 wherein the elongate stretcher is attached to the planar leg support by selectable insertion in a plurality of slots defined along the length of the planar leg support.

14. The medical apparatus as described in claim 1 wherein the slots are openings.

15. The medical apparatus as described in claim 1 further comprising means for stabilizing the planar leg support flexibly attached to the planar means.

16. The medical apparatus as described in claim 1 wherein the cushioning means completely surrounds and covers the first end of the planar means.

17. An apparatus for regaining motion in a previously traumatized knee joint comprising:

a) planar means for supporting a leg of a patient, the planar means having a first end and a second end;

b) means for cushioning the first end of the planar means adjacent a traumatized knee, the cushioning means completely surrounding and covering the first end of the planar means; and c) means for flexing a lower leg at a knee joint to stretch a traumatized knee.

18. The medical apparatus as described in claim 17, wherein the flexing means includes an elongate stretcher, the elongate stretcher being attached to the planar leg support by selectable insertion in a plurality of holes defined along the length of the planar leg support.

19. The medical apparatus as described in claim 17 wherein the planar means defines multiple sets of pluralities of holes, at varying distances from the first end to the second end along the length of the planar means for attachment of the flexing means, whereby patients of varying leg lengths may use the same planar leg support with proper fitment.

* * * * *